US006486592B1

(12) United States Patent
Nelson et al.

(10) Patent No.: US 6,486,592 B1
(45) Date of Patent: Nov. 26, 2002

(54) INTEGRAL NIGHT VISION TUBE CONTACT ASSEMBLY AND METHOD OF MAKING

(75) Inventors: John Carl Nelson, Salem, VA (US); Glen Anthony Maurice, Oak Hills, CA (US); George John Winter, Montvale, VA (US); John Michael Kessler, Buchanan, VA (US); Ronald Wesley Ward, Troutville, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 181 days.

(21) Appl. No.: 09/636,219

(22) Filed: Aug. 10, 2000

(51) Int. Cl.[7] ..... H01J 43/00

(52) U.S. Cl. ..... 313/103 CM; 313/318.01; 313/318.06

(58) Field of Search ..... 313/103 CM, 318.01, 313/318.05, 318.06

*Primary Examiner*—Vip Patel

(57) ABSTRACT

A universal contact assembly for an image intensifier tube wherein the pin socket and flat are both parts of an integrally formed unit. The pin socket has a through hole for accepting a wire lead to be soldered. A method of making a universal contact assembly wherein the pin socket shell and flat are machined from a single piece.

10 Claims, 5 Drawing Sheets

FIG. 1
(PRIOR ART)
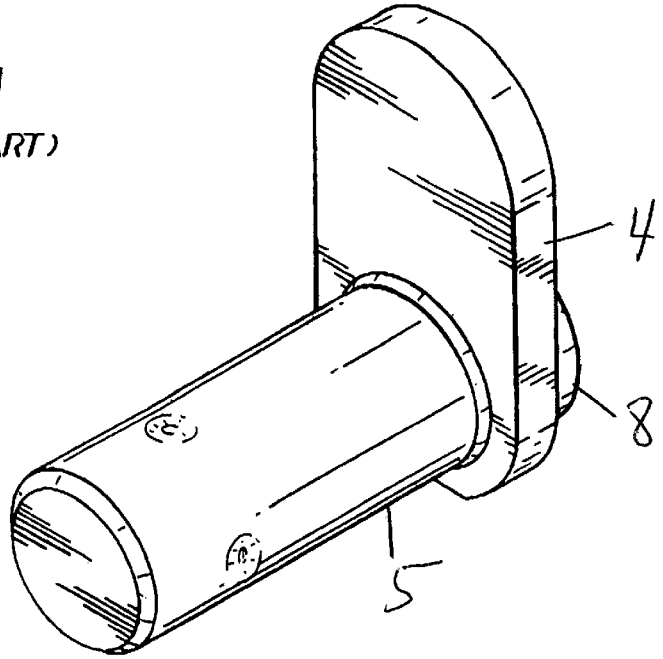
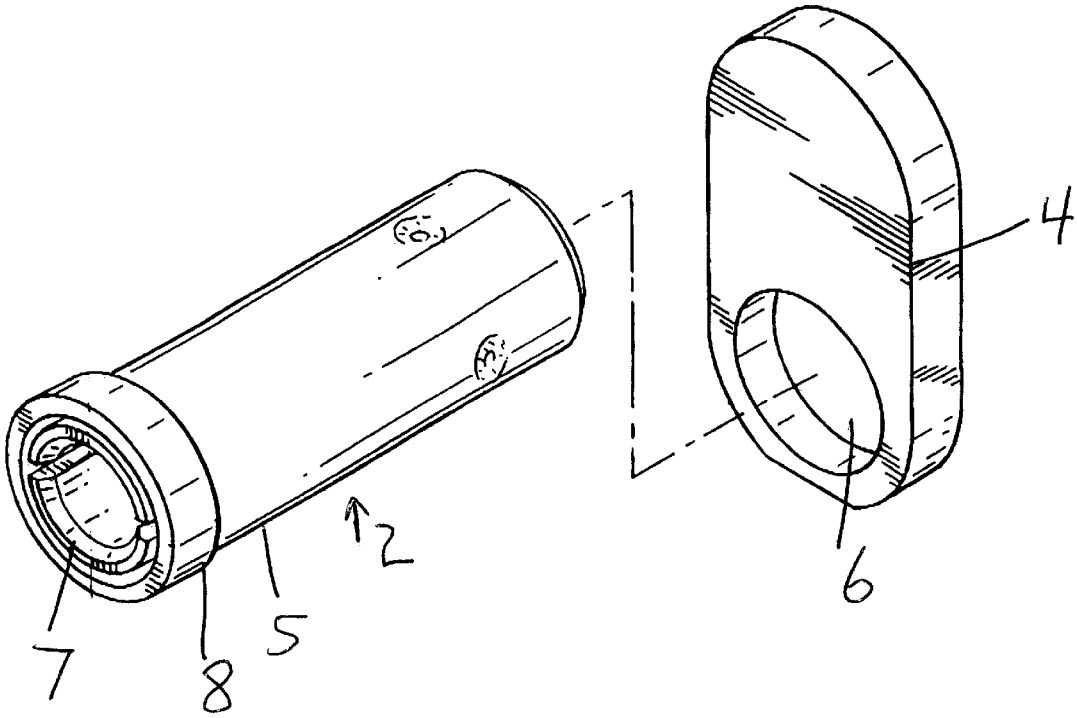
FIG. 2
(PRIOR ART)

FIG. 3
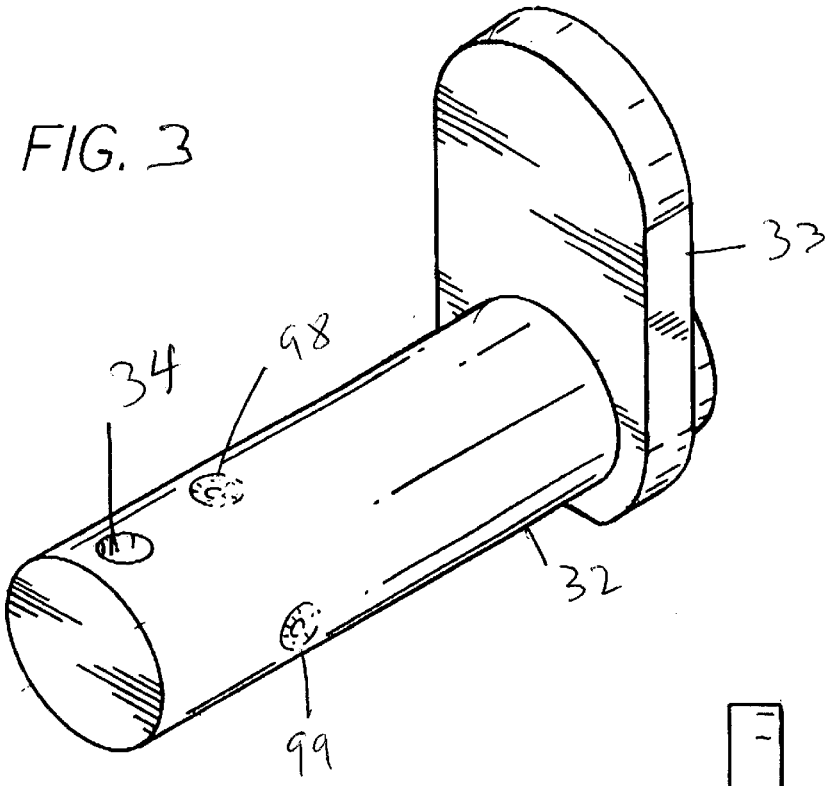
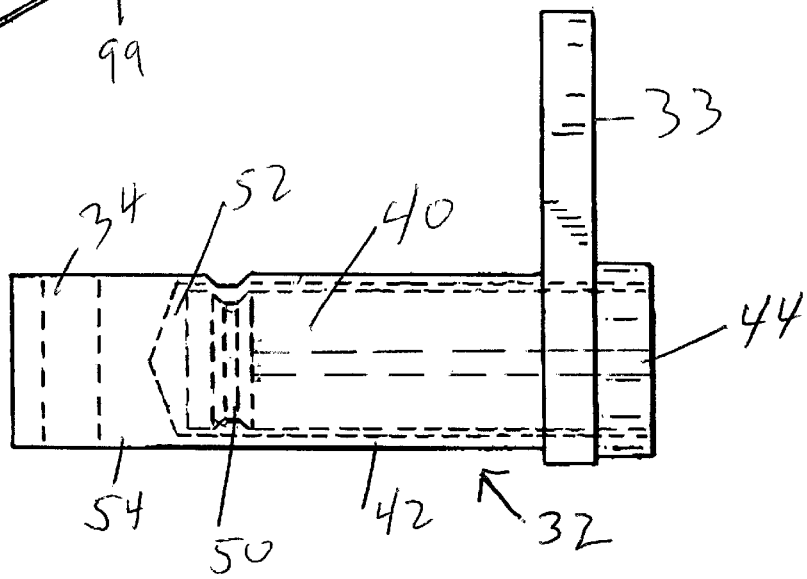
FIG. 4
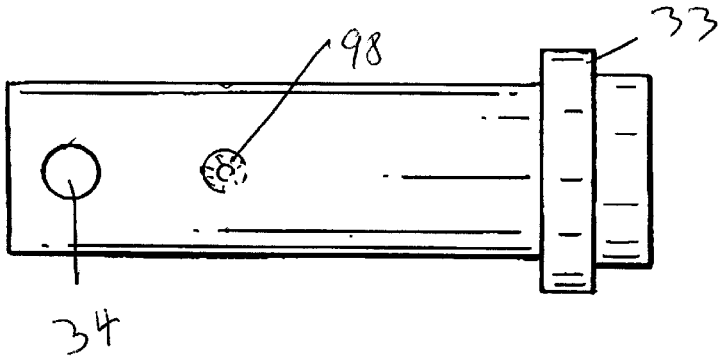
FIG. 5

INTEGRAL NIGHT VISION TUBE CONTACT ASSEMBLY AND METHOD OF MAKING

FIELD OF THE INVENTION

The present invention is in the field of image intensifier tubes, and particularly is directed to an improved contact assembly for an image intensifier tube, and to a method of making such assembly.

BACKGROUND OF THE INVENTION

Image intensifier tubes are utilized to enhance night time vision without using additional light. These devices have both military and industrial applications. The U.S. military uses image intensifier tubes for viewing and aiming at targets at night that otherwise would not be visible. In addition, image intensifier tubes are used by aviators to enhance night time vision, for providing night vision to people who suffer from night blindness (retinitis pigmentosa) and for photographing astronomical bodies.

Generally, an image intensifier tube includes three main components. These components include a photocathode, a phosphor screen (anode) and a microchannel plate (MCP) disposed between the photocathode and anode. The photocathode is a photoemissive waver that is extremely sensitive to low radiation levels of light in the 580–590 nm spectral ranges. When electromagnetic radiation impinges on the photocathode, the photocathode emits electrons in response.

The MCP is a relatively thin glass plate having input and output planes and an array of microscopic holes through it. An electron impinging on the MCP results in the emission of a number of secondary electrons which, in turn, cause the emission of more secondary electrons. Therefore, each microscopic hole acts as a channel type secondary emission electron multiplier having an electron gain of approximately several hundred. The electron gain is primarily controlled by a potential difference between the input and output planes of the MCP. Consequently, the MCP increases the density of electron emission.

The anode includes an output fiber optic window and a phosphor screen which is formed on a surface of the window. Emitted electrons are accelerated towards the phosphor screen by maintaining the phosphor screen at a higher positive potential than the MCP. The phosphor screen converts the electron emission into an image which is visible to an operator.

For the proper operation of the tube, there must be a potential difference across the MCP, and between the MCP and the screen. These voltages are provided by an external power source, typically a low voltage battery located outside the image intensifier tube and a power supply which is located around the periphery of the tube. The power supply includes an electronic chopper, step up transformer, a rectifier, and a voltage regulator to provide the appropriate voltages.

The image intensifier tube is bounded at one end by a back plate which bears a pair of contact assemblies. Power from the external source is provided to the tube by electrically connecting leads from the source to the contact assemblies. The U.S. Military specifies a particular night vision device as AN/PVS-7A. This device utilizes a contact assembly in the form of a pin socket, and power from the external source is applied via a pin which is inserted in the pin socket. Another U.S. Military specified night vision device is AN/PVS-7B, which uses a contact assembly in the form of a flat. Power is applied from the external source via a spring loaded pin contact which pushes against the flat.

To accommodate both the AN/PVS-7A and AN/PVS-7B specifications, a contact assembly known as a universal assembly has been utilized which has both a pin socket, and a flat at one end of the pin socket extending perpendicular thereto. When the universal assembly is seated in the back plate of an image intensifier tube, contact to the assembly may be made either by a pin inserted in the pin socket or by a spring loaded pin contact pushing against the flat.

The universal contact assembly of the prior art is comprised of two pieces which are soldered together. The first piece is a cylindrical pin socket and the second piece is a flat or "U-tube", which is a flat, elongated piece of metal shaped like an elongated letter "U". The flat has a hole in it, and the pin socket is inserted in the hole, whereupon the two parts are soldered together. The problem with the prior art structure is that the solder joint is not clean and therefore when the contact assembly is mounted in the back plate of the image intensifier tube, it does not seat squarely, and may move or become loose, adversely affecting tube operation.

Also, in the universal contact assembly of the prior art, the flat is at one end of the pin socket, while at the other end, the exterior surface of the cylindrical pin socket is soldered to a wire leading to the internally located power supply of the image intensifier tube. The wire is held to the pin socket only by solder. Soldering a wire end to a cylindrical rod (the pin socket) is inconvenient to accomplish and may result in breakage of the wires and consequent electrical disconnection during use.

SUMMARY OF THE INVENTION

In accordance with the first aspect of the present invention, a universal contact assembly for an image intensifier tube is provided wherein the pin socket and flat are both parts of an integrally formed unit. Hence, the junction of the two parts is clean and solder-free, and the contact assembly seats squarely in the back plate, and does not loosen.

In accordance with a second aspect of the invention, the pin socket is provided with a through hole in which a wire lead fed to the power supply may be inserted before soldering. This enables a quicker and more convenient solder operation, since the lead is held in the hole, with less possibility that the connection will be broken over the life of the tube.

In accordance with a third aspect of the invention, an improved method of making a universal contact assembly is provided.

BRIEF DESCRIPTION OF THE DRAWINGS

The invention will be better understood by referring to the accompanying drawings, wherein:

FIG. 1 shows an image intensifier tube contact assembly of the prior art;

FIG. 2 is an exploded view of the contact assembly of FIG. 1 depicting the two piece construction of the prior art contact assembly;

FIG. 3 shows the contact assembly of the invention;

FIG. 4 is a side view of the contact assembly of FIG. 3;

FIG. 5 is a plan view of the contact assembly of FIG. 3;

DETAILED DESCRIPTION OF THE PREFERRED EMBODIMENT

Figure 6:
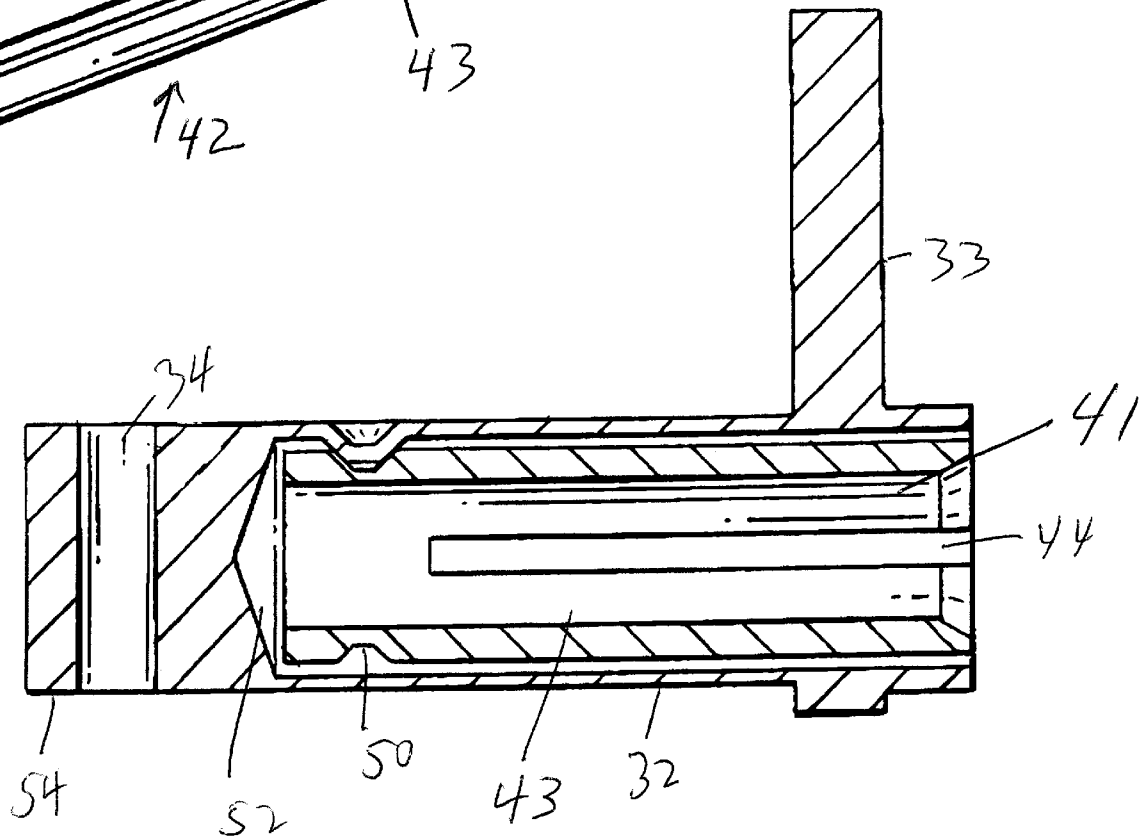
FIG. 6 shows the insert of the contact assembly.

As described above, the invention is concerned with an improved universal contact assembly for an image intensifier tube. A prior art universal contact assembly is depicted in FIGS. 1 and 2.

Referring to FIG. 2, which is an exploded view of the assembly, it is seen to be comprised of pin socket 2 and flat member 4. The pin socket 2 includes shell 5 and tensioned insert 7 in which a pin could be inserted. The particular flat member 4 (hereinafter "flat") which is illustrated has a shape similar to that of the letter "U" with elongate sides, and is sometimes referred to as a "U-tube". Flat 4 has a circular opening 6, while pin socket 2 has a shoulder 8 at the one end. The universal contact assembly of the prior art is assembled by inserting the pin socket through the opening 6, and soldering the two pieces together with the flat abutting the shoulder, to result in the structure shown in FIG. 1.

When the universal contact assembly of FIG. 1 is seated against the back plate of an image intensifier tube, leads from an external power source may be connected either by inserting a pin in insert 7 of the pin socket 5, or by positioning a spring loaded contact against the flat 4. The contact assembly would be connected to a power supply which is internal to the image intensifier tube by a wire which is soldered to the exterior of pin socket shell 5 in the vicinity of the near end of the pin socket as shown in FIG. 1.

Figure 12:
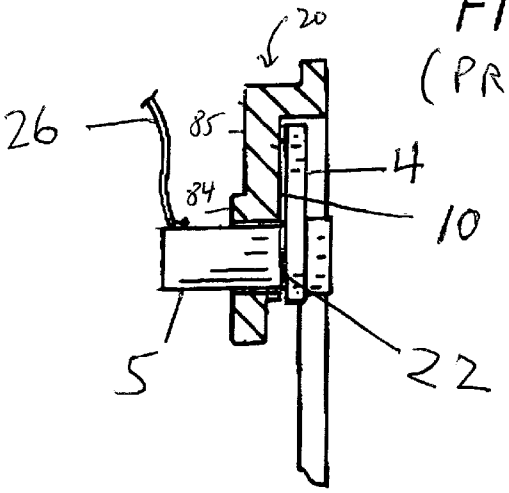
FIG. 12 (PRIOR ART)
FIG. 12 is a sectional view of the prior art contact assembly of the invention as deployed in the back plate of an image intensifier tube.

The prior art configuration results in two problems, which are illustrated in FIG. 12. In this figure, the flat is seated against the surface of back plate 20, while the solder joint between the flat and the pin socket is depicted at 22. The solder joint prevents a square fit between the flat and the back plate, with a space 10 resulting. Thus, the contact assembly may be loose in its mounting.

Referring again to FIG. 12, it is seen that wire 26 which connects to the power supply is soldered directly to the exterior of the pin socket shell 5. This soldering process is awkward in that there is no means to hold the wire, and the wire may break off during operation.

These problems are solved by the present invention, which is illustrated in FIGS. 3 to 11. The structure of FIG. 3 differs from that of FIG. 1 in that the pin socket 32 and flat 33 of FIG. 3 are all one metallic piece, i.e. that are both parts of an integrally formed unit. Also, the structure of FIG. 3 includes through hole 34 in pin socket 32 (also see FIGS. 4 and 5) through which a lead wire is passed before soldering, to result in both ease of soldering and a more reliable connection.

Figure 7:
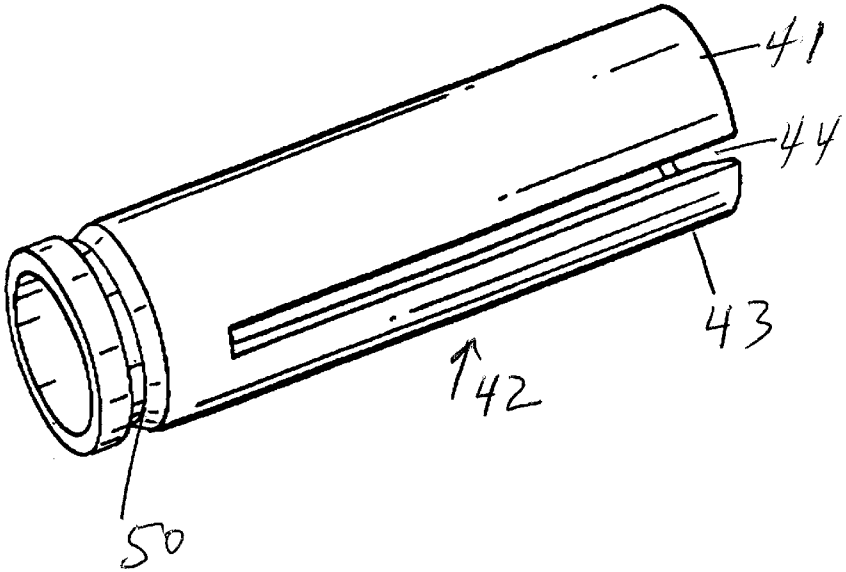
FIG. 7 is a sectional view of the contact assembly of FIG. 3.

FIGS. 4, 6 and 7 show the insert 40 which fits into shell 42 of the pin socket. The insert has split 44 and another split diametrically opposed to split 44 (not shown), which divides the insert into spring fingers 41 and 43, which grip the pin when inserted. The insert also has circumferentially extending recess 50.

As shown in FIGS. 4 and 6, most of the interior of the pin socket shell 42 is hollow (i.e., see portions 52) for accepting the insert, while portion 54 is solid (except for hole 34). Insert 40 is pushed into the hollow interior of shell 42 as far as it will go, and the shell is then crimped to hold the insert in place. In the preferred embodiment, three crimps are used spaced equally around the periphery, at a longitudinal position so as to line up with recess 50. Two such crimps, 98 and 99 are shown in FIG. 3.

Figure 9:
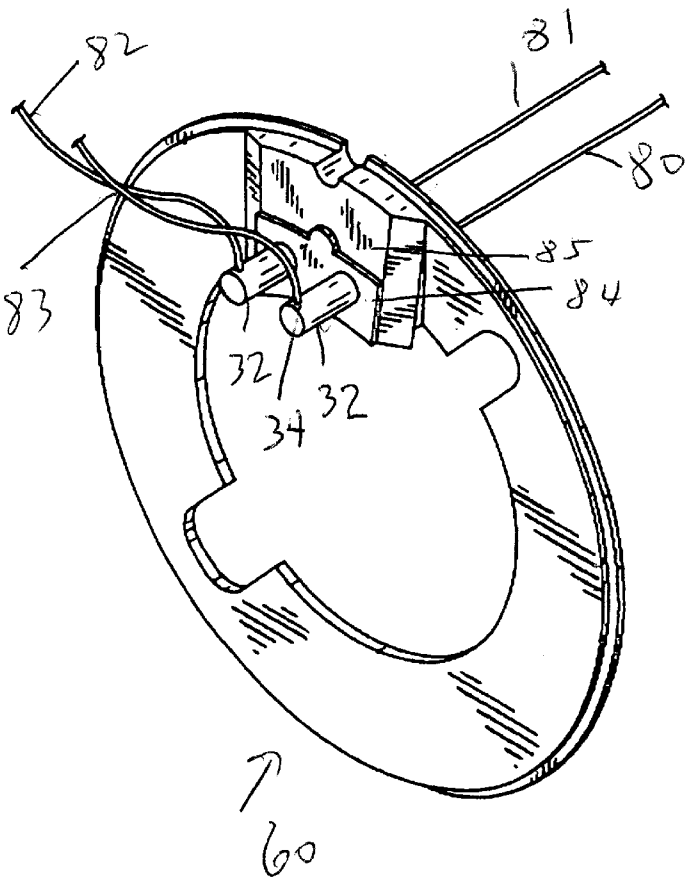
FIGS. 8 and 9 shows the back plate of the image intensifier tube having the contact assembly of the invention mounted therein.
Figure 8:
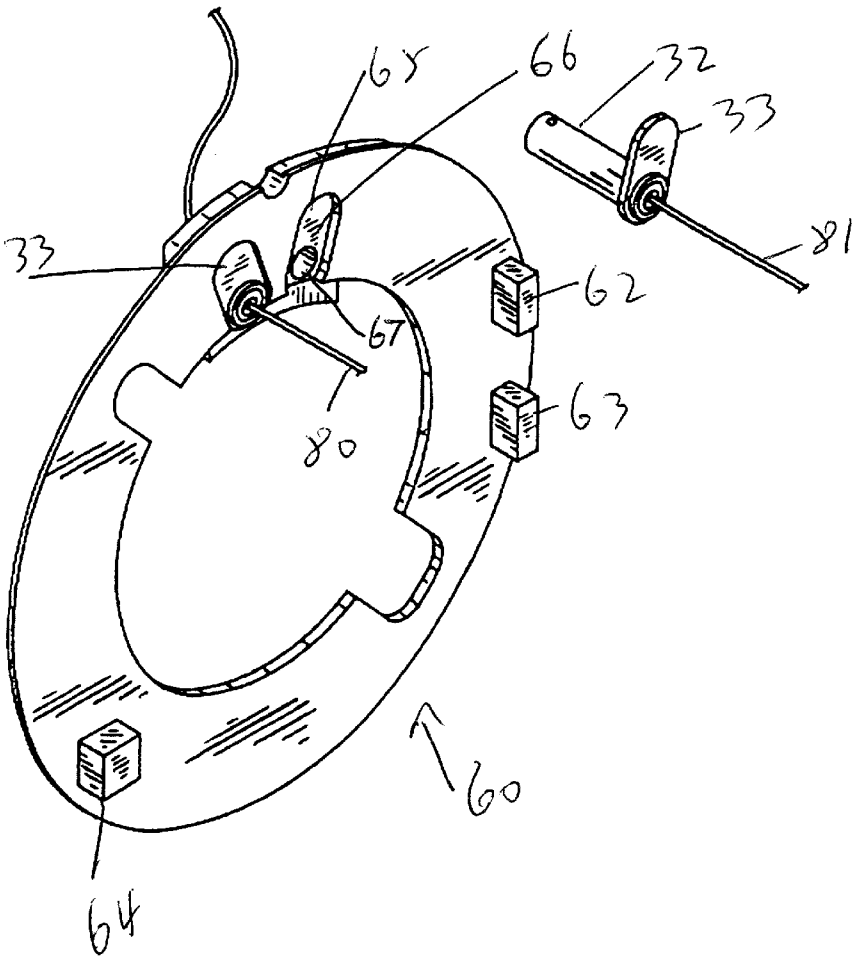

FIGS. 8 and 9 show the back plate 60 of an image intensifier tube, which has the universal contact assembly of the invention mounted therein. The back plate is made of a plastic material and has projections 62, 63 and 64 which can plug into part to which the image intensifier tube is conjoined.

Referring to FIGS. 8 and 9, the back plate is seen to have two cut outs 65 in which there are seating surfaces 66 for the flats and holes 67 which extend through the seating surfaces and through mount 84, 85 (FIG. 9), which is for holding the bodies of the pin sockets. In order to install a contact assembly in the back plate, it is pushed into a hole 67 until the flat contacts the seating surface, and is cemented in this position. FIG. 8 shows pins 80 and 81 inserted in pin sockets, while FIG. 9 shows leads 82 and 83 soldered in holes 34 in the pin sockets.

Figure 11:
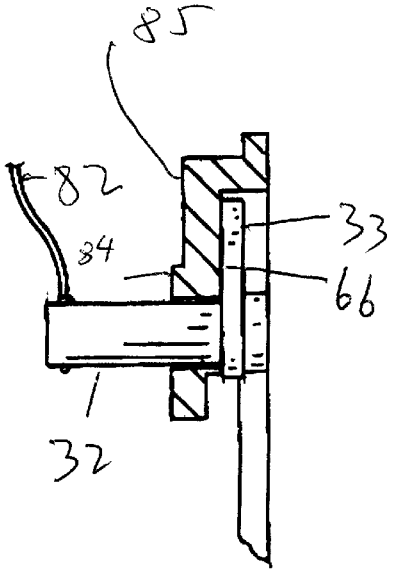
FIG. 11 is a sectional view of the improved contact assembly of the invention as deployed in the back plate of an image intensifier tube.

FIG. 11 shows how the flat 33 sits squarely against the seating surface 66 of the back plate, and how the wire lead 82 is securely soldered in the through hole 34 of the pin socket. This is to be contrasted with the prior art arrangement shown in FIG. 12 where the flat does not sit squarely against the seating structure, and where the lead wire is not as securely soldered to the pin socket.

Figure 10:
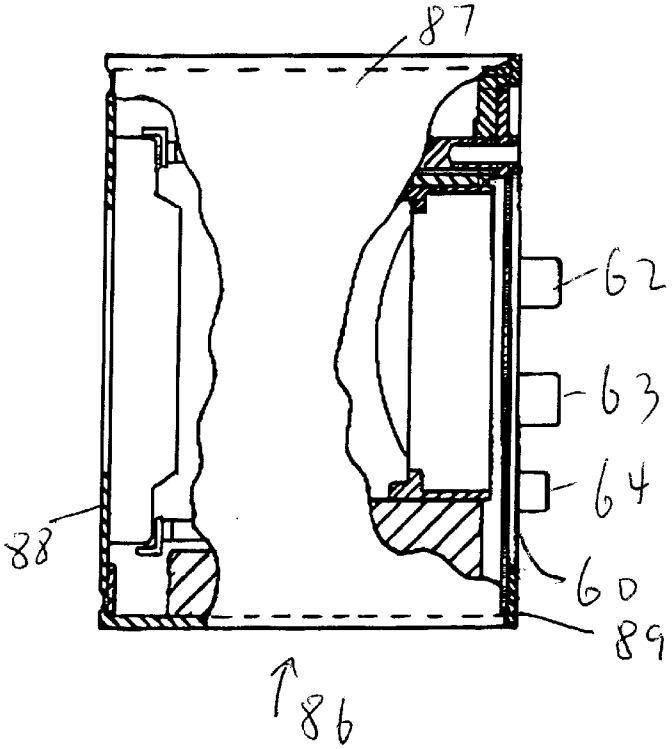
FIG. 10 shows an image intensifier tube.

FIG. 10 depicts image amplifier tube 86 having a cathode end 88 and a viewing end 89. As can be seen, back plate 60 having projections 62, 63 and 64 is mounted at the viewing end of the tube.

A method of making the improved universal socket assembly of the invention will now be described. The one piece pin socket outer shell/flat combination is automatically machined from a solid slug of metal by a programmable machine tool which is set to produce the shape depicted in the figures. In an actual procedure, a spherical ball of ½ inch diameter brass was first trimmed on a lathe. The resulting spherical brass ball was automatically milled by a milling machine operating under programmed central numeric control to produce the depicted shape. The actual length of the pin socket produced was 0.365".

The insert was then milled from a solid slug of diameter brass, and its length was 0.265". The insert is then manually placed in the shell, and the shell is crimped at three equally spaces around the periphery to hold the insert in place.

There thus has been disclosed an improved universal contact assembly for an image intensifier tube. While the invention has been disclosed in connection with a preferred embodiment, variations will occur to those skilled in the art, and the invention is defined in the claims appended hereto.

What is claimed is:

1. In an image intensifier tube which is bounded on one end by a back plate bearing a contact assembly for connection to an external power source, wherein the contact assembly comprises the combination of a longitudinally extending pin socket having an interior for accepting and holding a conductive pin and a conductive flat member which surrounds the pin socket at a position along the pin socket length and extends in a substantially perpendicular direction outwardly from the pin socket, the improvement wherein;

both the pin socket and the flat member are parts of integrally formed unit.

2. The image intensifier tube of claim 1, wherein the flat member is elongated and has substantially all of its length to one side of the pin socket.

3. The image intensifier tube of claim 2, wherein the flat member is a U-tube.

4. The image intensifier tube of claim 3, wherein the pin socket at a first longitudinal end has an entrance to the interior for accepting and holding a conductive pin and near a second longitudinal end has a hole entirely therethrough in the direction perpendicular to the lengthwise dimension of the pin socket for allowing insertion and soldering of a wire lead.

5. The image intensifier tube of claim 4, wherein the pin socket is cylindrical of a first diameter and wherein it has a shoulder of a second diameter greater than the first diameter located at the first longitudinal end, which abuts the flat member.

6. The image intensifier tube of claim 5, wherein the pin socket is comprised of an outer shell and an insert located in the interior of the outer shell having spring fingers for holding a pin which is inserted therein.

7. The image intensifier tube of claim 6, wherein the insert is held in the outer shell by a plurality of crimps.

8. The image intensifier tube of claim 7, wherein the flat member is a U-tube.

9. A method of making a contact assembly for an image intensifier tube, comprising the steps of:

providing a first piece of metal, from the first piece of metal, automatically machining an outer piece of the contact assembly comprised of an at least partially hollow longitudinally extending pin socket shell and an elongated flat member which surrounds the pin socket shell near one end and extends outwardly from the shell in a substantially perpendicular direction to the shell, providing a second piece of metal, from the second piece of metal, automatically machining an insert having spring fingers for the pin socket shell, and inserting the insert into the pin socket shell.

10. The method of claim 9, further including the step of crimping the shell to retain the insert therein.

* * * * *